US008734311B2

(12) United States Patent
Mackel et al.

(10) Patent No.: US 8,734,311 B2
(45) Date of Patent: May 27, 2014

(54) CENTRIFUGE HAVING TUBULAR ELEMENTS ON AN OUTSIDE CIRCUMFERENCE OF A DISK PACKAGE

(75) Inventors: Wilfried Mackel, Lippetal (DE); Helga Tietz, Oelde (DE)

(73) Assignee: GEA Westfalia Separator GmbH, Oelde (DE)

( * ) Notice: Subject to any disclaimer, the term of this patent is extended or adjusted under 35 U.S.C. 154(b) by 506 days.

(21) Appl. No.: 12/992,284

(22) PCT Filed: May 11, 2009

(86) PCT No.: PCT/EP2009/003315

§ 371 (c)(1), (2), (4) Date: Apr. 28, 2011

(87) PCT Pub. No.: WO2009/138196

PCT Pub. Date: Nov. 19, 2009

(65) Prior Publication Data

US 2011/0212821 A1 Sep. 1, 2011

(30) Foreign Application Priority Data

May 13, 2008 (DE) ..... 10 2008 023 383

(51) Int. Cl.
*B04B 1/08* (2006.01)
*B04B 7/14* (2006.01)

(52) U.S. Cl.
USPC ..... 494/71; 494/73

(58) Field of Classification Search
USPC ..... 494/2–4, 40, 67–73, 74, 79
See application file for complete search history.

(56) References Cited

U.S. PATENT DOCUMENTS

| | | | | | |
|---|---|---|---|---|---|
| 2,301,109 | A | * | 11/1942 | Clayton | 554/175 |
| 2,599,619 | A | * | 6/1952 | Eckers | 494/28 |
| 2,662,687 | A | * | 12/1953 | Spross | 494/41 |
| 3,328,282 | A | * | 6/1967 | Keith, Jr. et al. | 208/28 |
| 3,529,767 | A | * | 9/1970 | Keith, Jr. et al. | 494/27 |
| 2011/0212821 | A1 | * | 9/2011 | Mackel et al. | 494/68 |

FOREIGN PATENT DOCUMENTS

| | | | |
|---|---|---|---|
| DE | 654319 | | 12/1937 |
| DE | 36 20 548 | | 12/1987 |
| DE | 10338770 | A1 * | 3/2005 |
| FR | 1.359.356 | | 3/1964 |
| GB | 567959 | | 3/1944 |
| GB | 728822 | | 4/1955 |
| SU | 598648 | * | 3/1978 |

* cited by examiner

*Primary Examiner* — Charles E Cooley
(74) *Attorney, Agent, or Firm* — Barnes & Thornburg LLP

(57) ABSTRACT

A centrifuge includes a drum having a vertical rotational axis, a single or double conical inner jacket, an inlet pipe, a distributor into which the inlet pipe opens, the distributor having at least two distributor channels distributed about a circumference of the distributor, and a disk package including separator disks. Further included are tubular elements distributed on an outside circumference of the disk package, the tubular elements being fastened externally to the separator disk package.

23 Claims, 5 Drawing Sheets

CENTRIFUGE HAVING TUBULAR ELEMENTS ON AN OUTSIDE CIRCUMFERENCE OF A DISK PACKAGE

BACKGROUND OF THE INVENTION

This application is a national stage of International Application PCT/EP2009/003315, filed May 11, 2009 and claims benefit of and priority to German Patent Application No. 10 2008 023 383.8, filed May 13, 2008, the content of which Applications are incorporated by reference herein.

BACKGROUND OF THE INVENTION

The present disclosure relates to a centrifuge, for example, a continuously working separator. The centrifuge includes a drum having a vertical rotational axis, a single or double conical inner jacket, and an inlet pipe opening into a distributor having at least two or more distributor channels distributed about the circumference of the distributor. The centrifuge further comprises a disk package including separator disks.

Such separators are known. See, for example, DE 36 20 548 A1, GB 728 822 A, FR 13 59 356 A and DE 654 319 A1.

There is still a need for improvement especially in the manner of feeding the centrifuge material to a separator disk package. This is so when the centrifuge is arranged in such a way that the centrifuge material in the drum flows radially from the outside into the separator disk package.

It is known from DE 654 319 A to provide formed parts in a disk package in the individual separator disks in an outer boundary circumferential region which is aligned horizontally, and which formed parts form a kind of riser channel in cooperation in the axial direction.

It is known from U.S. Pat. No. 2,599,619 A to distribute at least tubular elements on the outside circumference of the disk package, which tubular elements are open radially inwardly and comprise individual, axially offset slits towards the outside, so that solid material can exit to the outside. These channels are integrated in the bottom part of the drum, which is very impractical and is unstable in operation.

The present disclosure relates to, among other things, optimizing the feed of the centrifuge material to be processed into the disk package in the drum.

Thus, the present disclosure relates to a centrifuge that includes a drum having a vertical rotational axis, a single or double conical inner jacket, an inlet pipe, and a distributor into which the inlet pipe opens. The distributor includes at least two distributor channels distributed about a circumference of the distributor. The centrifuge further includes a disk package including separator disks and tubular elements that are distributed on an outside circumference of the disk package. The tubular elements are fastened externally to the separator disk package.

Accordingly, at least one or more tubular elements are arranged on the outside circumference of the disk package, so that a riser-channel-like feed line into the separator disk package occurs in a simple way, distributed, for example, over its entire axial height. As noted above, the tubular elements are further fastened on the outside to the separator disk package.

The feed of the centrifuge material into the drum and into the separator disk package is thus optimized. The arrangement is also secure and stable at high speeds. Moreover, it is easy to produce in contrast to the generic state of the art.

The term tubular elements shall not be considered in a too narrow sense. For example, the tubular elements may comprise a large variety of shapes in tubes or ducts that are not enclosed circumferentially. A semi-cylindrical duct-like shape may be especially advantageous, with the open side of these ducts facing radially towards the inside. The ducts can have a semi-circular cross section, but also a flattened or angular cross section.

The present disclosure also relates to providing duct-like depressions and/or deflection areas each arranged in the surface of the piston slide or the distributor facing the interior space of the drum beneath the opening area of each distributor channel into the drum. The depressions extend from this area in, for example, a radial manner slightly, that is, for example, a few centimeters, radially up to and over the outer circumference of the disk package and are arranged in their end region in such a way that they deflect a product stream guided through the distributor channels into the drum axially upwardly parallel to the rotational axis radially outside of the largest circumference of the separator disk package. Thus, an optimized introduction of the product to be processed into the separator disk stack in the drum may already be achieved. An especially advantageous product feed may be achieved when the duct-like depressions and/or deflection areas are combined with the tubular elements.

Other aspects of the present disclosure will become apparent from the following descriptions when considered in conjunction with the accompanying drawings.

DETAILED DESCRIPTION

Figure 1:
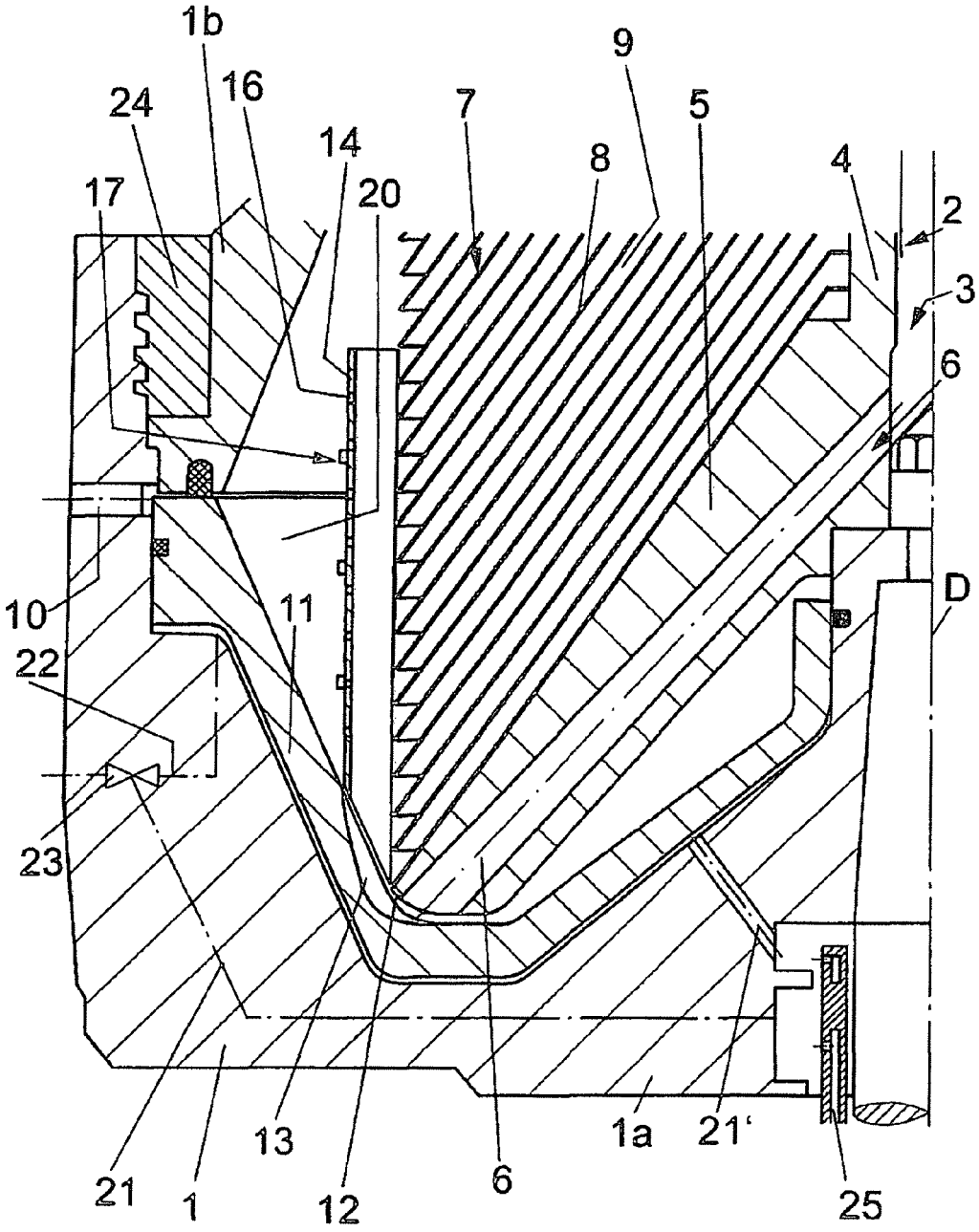
FIG. 1 shows a sectional view of a partial area of a separator drum, according to the present disclosure.
Figure 3:
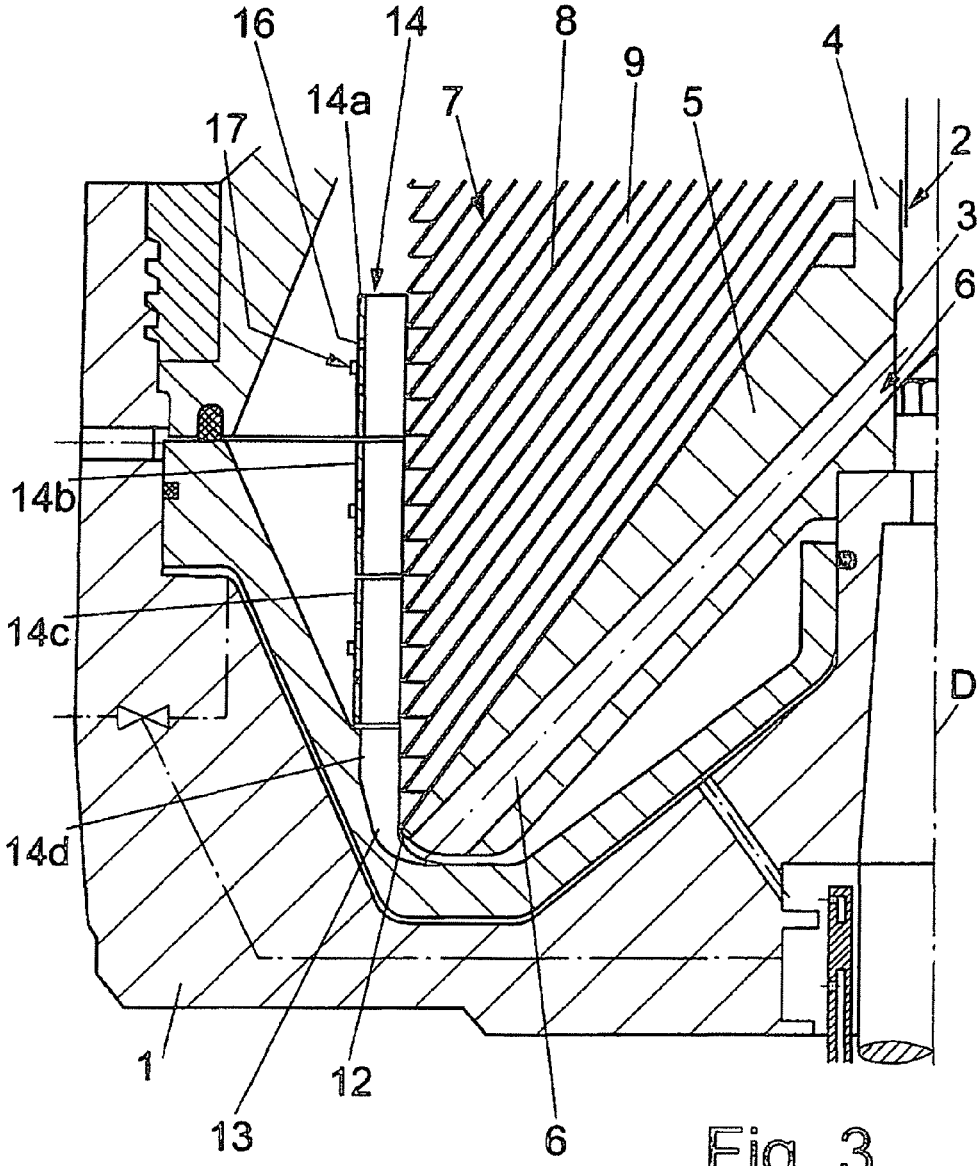
FIG. 3 shows a sectional view of a partial area of a third separator drum, according to the present disclosure.

FIGS. 1 and 3 show a partial area of a bottom part of a drum 1 configured for continuous operation with vertical rotational axis D of a centrifuge arranged as a separator in an embodiment according to the present disclosure.

Drum 1 may comprise a single or double conical inside jacket and a single or double outside jacket. Drum 1 may be arranged in several parts and comprises a drum closing ring 24 which holds together a bottom drum part 1*a* and an upper drum part 1*b* of drum 1.

Drum 1 comprises an inlet pipe 2 which opens into a distributor 3, comprising a first tubular section 4 and an adjacent, conically expanding section 5.

Section 5 is distributed over a circumference and is provided with distributor channels 6 which extend relative to the vertical rotational axis D in the radial direction in a downwardly oblique fashion and which are arranged in this embodiment in a tubular cylindrical way.

A disk package 7 includes separator disks 8, acting in a separating and/or clearing manner, and is arranged on the distributor 3. Between the disks 8 one spacer gap each is formed, the height of which gap is determined by lugs 9.

Drum 1 comprises at least one fluid outlet, or several fluid outlets, such as skimmer disks, not shown, and solid discharge openings 10 which are distributed over the circumference of the region of the largest diameter of the drum 1 which may be conical in a single or double way. The solid discharge openings 10 can be opened or closed with the help of, for example, a fluid-actuated piston slide 11 in drum 1 in order to remove a solid phase from the drum 1.

The piston slide 11 may be actuated hydraulically, for which purpose a hydraulic system can be provided which may comprise a control-water feed bore 21, a control valve 23, a control-water line bore 22, and/or a control water feed 25.

Centrifuge material to be guided into the drum 1 is guided through the inlet pipe 2 and the distributor channels 6 about the bottom outer edge 12 of the distributor 3 into the disk package 7 or the gap between the separator disks 8.

Duct-like depressions as deflection areas 13 may be arranged beneath an opening area of each distributor channel 6 in a surface of the piston slide 11 facing the interior space of the drum 1 or the disk package 7. The depressions 13 may extend from this area 13 in, for example, a radial manner slightly, for example, by a few centimeters, up to and over the outer circumference of the disk package 7. The depressions 13 are arranged in their end region in a convex manner in such a way that they deflect a product stream guided through the distributor channels 6 into the drum 1 axially upwardly into tubular elements 14 parallel to the rotational axis D radially outside of the largest circumference of the separator disk package 7.

The tubular elements 14 may be directly radially outwardly adjacent to the outer circumference of the separator disk package 7 and extend parallel to the rotational axis D of drum 1.

The piston slide 11 is moved downwardly during discharges, whereas the tubular elements 14 remain on the separator stack of disks 8. The tubular elements 14 form a duct which can include a continuous axial piece, as shown in FIG. 1 or of several sections which are placed axially on each other, as shown in FIG. 3.

The tubular elements 14 protrude radially into a solid chamber 20.

Figure 4:
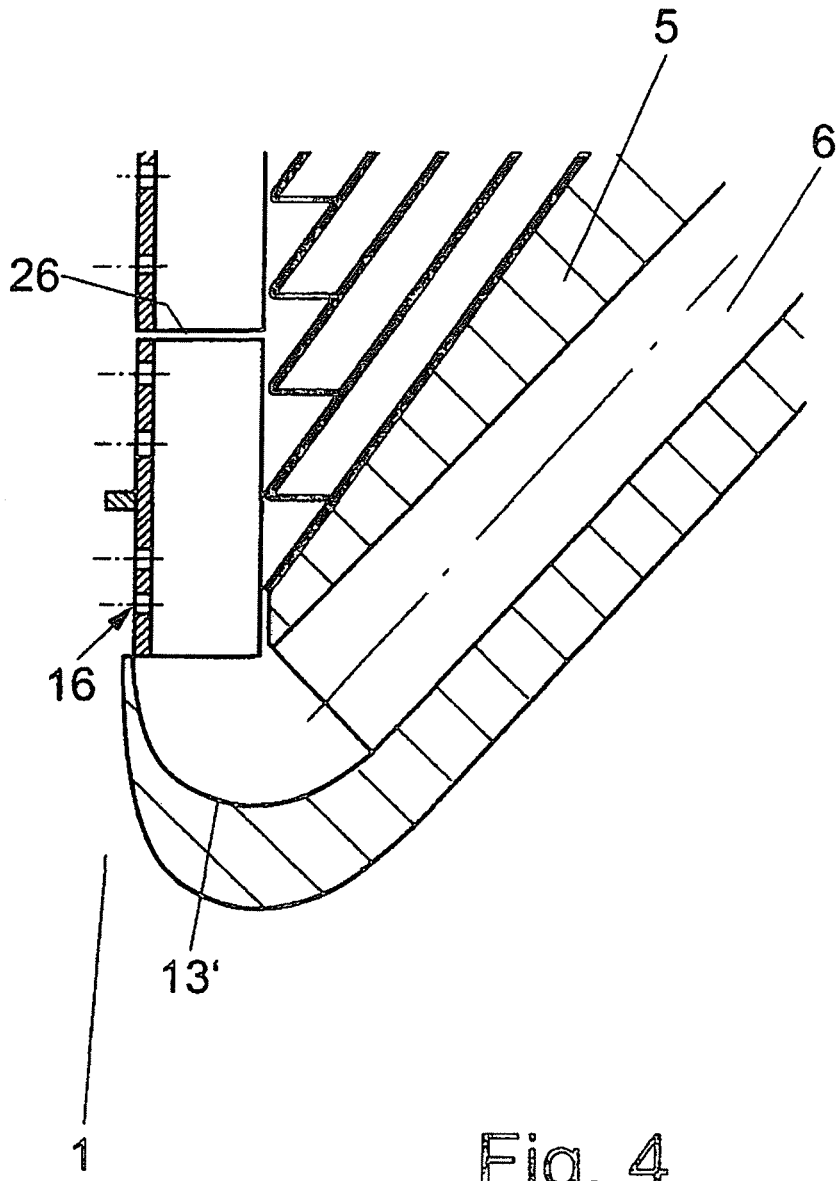
FIG. 4 shows a sectional view of a partial area of a fourth separator drum, according to the present disclosure.

It is within the scope of the present disclosure that the distributor section 5, as shown in FIG. 4, is arranged in such a way that a deflection occurs in the same way in the last of section 5 before its outlet opening upwardly into the tubular elements 14, wherein a kind of deflection area 13', in the manner of a duct-like depression, can be formed in the distributor 3 itself, for example. Such an embodiment is especially useful when the drum 1 does not comprise a piston slide 11 but includes nozzles as solid discharge openings, through which a continuous discharge of a solid phase can occur.

Figure 2A:
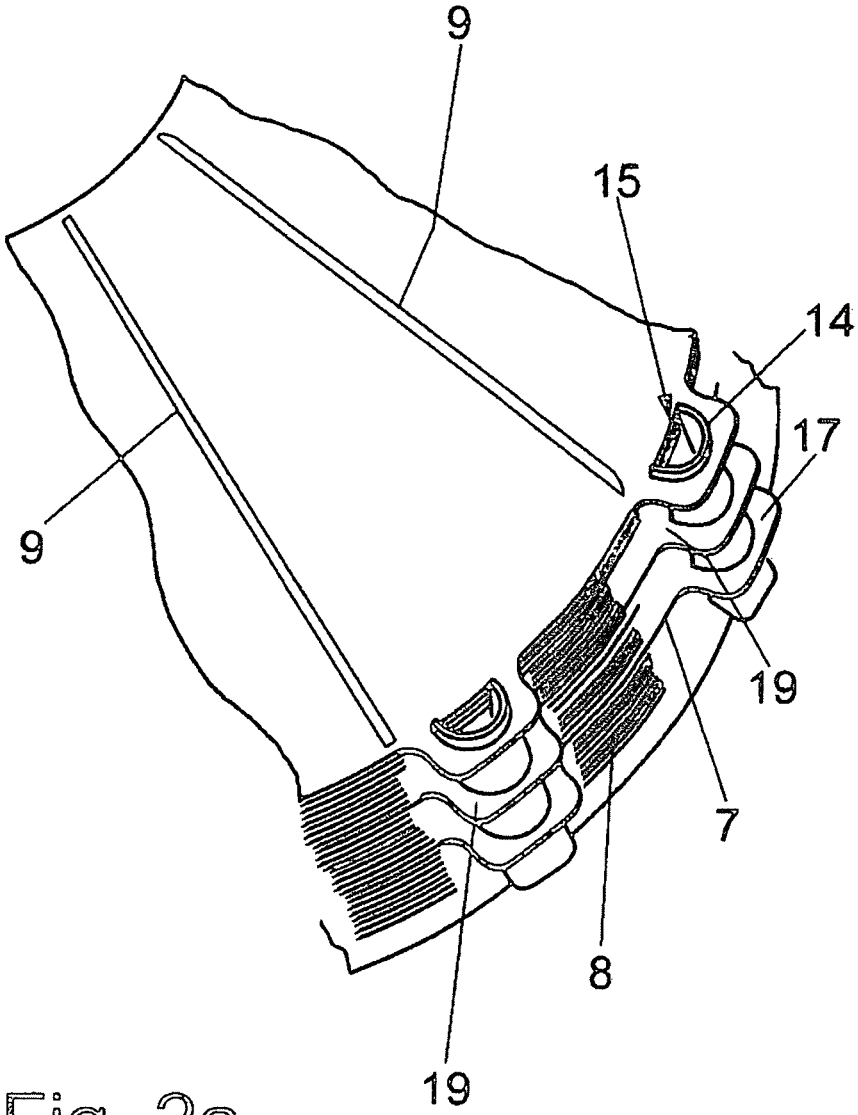
FIG. 2*a* shows a perspective view of a partial area of the separator drum of FIG. 1.

The separator disks 8 are separated from one another by radial lugs 9, as shown in FIG. 2, and form disk gaps when placed above one another. The tubular elements 14 may, for example, lie within two lugs 9 and may be directly behind the lugs 9, with reference to the direction of rotation D of the drum 1.

The tubular elements 14 may, for example, be arranged so as to be not fully enclosed circumferentially, but may comprise an axially extending gap or open area 15, as shown in FIG. 2, radially in the drum 1 towards the inside, through which the centrifuge material can enter into the disk package 7 radially to the inside.

The tubular elements 14 may, for example, be further provided with axially spaced openings 16 in their region disposed in the drum 1 radially to the outside. The openings 16 form a perforation-like structure by cooperation. The discharged solid material can reach through these openings 16 from the tubular element 14 into the solid chamber 20.

The tubular elements 14 can extend in the vertical direction over the entire height of the separator disk package 7, but need not necessarily do so.

The tubular elements 14 allow an especially even distribution and feed of the product to be processed to the separator disk package 7. It is, therefore, especially advantageous when each distributor channel 6 is associated with one each of the tubular elements 14 and a deflection duct or area 13.

The tubular elements 14 may be fastened to the outside of the separator disk package 7, that is, to one or several holding disks 19, which disks 19 are each placed at a predetermined axial distance from each other between the separator disks 8 of the separator disk package 7. The tubular elements 14 can also only penetrate the holding disks 19 and be guided in the same in an interlocking manner, for example, which tubular elements 14 may then be welded to at least one point, for example, to the lowest holding disk 19. This type of arrangement of the tubular elements 14 is especially simple and easy to mount because the number of necessary joints between the separator disks 8 and the tubular element 14 is limited to only one single area.

The holding disks 19 can each be arranged at a distance from a specific number of separator disks 8 in the disk package 7, so that they can fulfill the function of a "normal" separator disk, on the one hand, and are provided with lugs 17 or mounts, on the other hand.

The holding disks 19 can be provided on their outer circumference with ring-like projections or disk lugs 17 which are penetrated by the tubular elements 14 in, for example, what may be an interlocking manner.

The tubular elements 14 are thus held in a simple way in the drum 1.

It is within the scope of the present disclosure to connect the tubular elements 14 with the separator disk package 7 at one point, for example, especially to a holding disk 19, in a supplementary or alternative manner.

It is within the scope of the present disclosure to fasten the tubular elements 14 in a supplementary manner to the distributor 3.

The tubular elements 14 may be arranged in an integral manner, but also in several parts.

It is within the scope of the present disclosure to compose a tubular element 14 from several rib-like plates or to arrange a tubular element 14 in such a way that two rib-like plates are arranged in the manner of a V or L. The shape of a U or a semi-circle is also within the scope of the present disclosure.

When the tubular element 14 is formed by a multiplicity of parts, individual elements, for example, elements 14*a, b, c*, and *d* are each fastened to a holding disk. An axial overlap of the elements 14*a, b, c*, and *d* is within the scope of the present disclosure in a respective configuration. It is within the scope of the present disclosure that there may be a larger number of parts than just 14*a-d*.

A substantially closed duct outside on the disk package 7 may be obtained by choosing a suitable number of separating disks 8 between the holding disks 19. Remaining gaps 26 are negligible with respect to the effect of the tubular element 14.

Figure 2B:
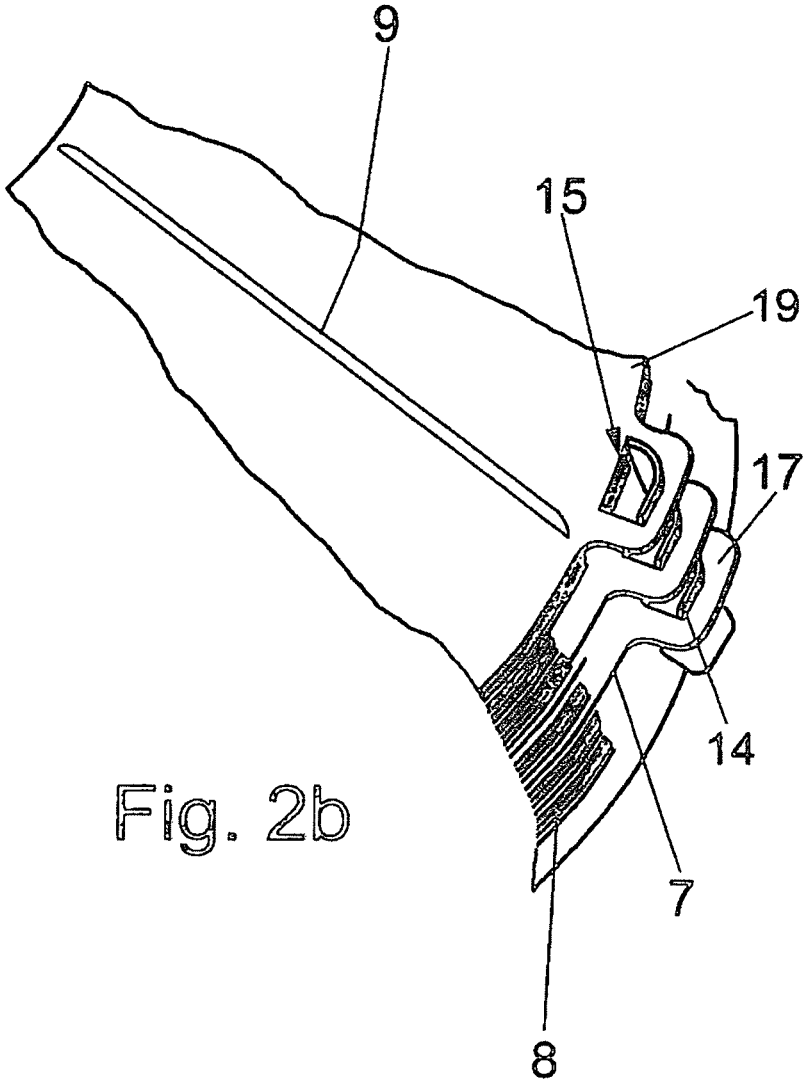
FIG. 2*b* shows a perspective view of a partial area of second separator drum, according to the present disclosure.

An arrangement in the manner of an L requires that the base leg is arranged in such a way that the product exiting from the distributor channel 6 is entrained by this base leg in the circumferential direction or the rotational direction, as suggested in FIG. 2*b*. The second leg seals the path radially into the solid chamber 20.

The tubular elements 14, within the scope of the present disclosure, may protrude radially slightly to the inside of the disk packages 7. That is, when they comprise recesses on their outside circumference which form a kind of duct on the outside circumference of the separator disk package 7 (not shown) in which the edges of the tubular elements 14 engage.

Although the present disclosure has been described and illustrated in detail, it is to be clearly understood that this is done by way of illustration and example only and is not to be taken by way of limitation. The scope of the present disclosure is to be limited only by the terms of the appended claims.

We claim:

1. A centrifuge, such as a continuously working separator, comprising:

a drum having a vertical rotational axis, a single or double conical inner jacket, an inlet pipe, a distributor into which the inlet pipe opens, the distributor having at least two distributor channels distributed about a circumference of the distributor, and a disk package including separator disks;

tubular elements distributed on an outside circumference of the disk package;

the tubular elements being fastened externally to the separator disk package; and wherein the tubular elements are held on the outside circumference on the separator disk package on one or more holding disks which are each placed at a predetermined axial distance from one another between the disks of the separator disk package.

2. The centrifuge according to claim 1, wherein the tubular elements are located directly adjacent to an outer circumference of the separator disk package.

3. The centrifuge according to claim 1, wherein the tubular elements extend parallel to the rotational axis of the drum and the tubular elements are arranged so as not to be circumferentially enclosed.

4. The centrifuge according to claim 1, wherein the tubular elements are each arranged to be inwardly open radially in the drum so that centrifuge material to be processed can enter the disk package radially to the inside.

5. The centrifuge according to claim 1, wherein the tubular elements include axially spaced openings in a region disposed radially further to an outside in the drum, which openings form a structure perforated by the openings.

6. The centrifuge according to claim 1, wherein the tubular elements extend in a vertical direction over a portion of an axial height or over an entire height of the separator disk package.

7. The centrifuge according to claim 1, wherein the one or more holding disks include, on their outer circumference, projections which are penetrated by the tubular elements in an interlocking manner.

8. The centrifuge according claim 1, wherein one of the tubular elements is associated with each of the distributor channels.

9. The centrifuge according to claim 1, wherein the tubular elements include a cross section shaped as a duct.

10. The centrifuge according to claim 9, wherein an open side of the duct-shaped tubular elements faces radially to an inside of the drum.

11. The centrifuge according to claim 1, wherein the tubular elements are formed in an integral manner.

12. The centrifuge according to claim 1, wherein the tubular elements are guided on an outside on the separator disk package.

13. The centrifuge according to claim 1, wherein the tubular elements are fastened in a supplementary manner to the distributor.

14. The centrifuge according to claim 1, wherein the drum includes at least one fluid outlet, and also includes solid discharge openings distributed over a circumference in a region of the largest diameter of an inwardly double conical inner jacket.

15. The centrifuge according to claim 14, wherein the solid discharge openings are nozzles.

16. The centrifuge according to claim 14, further including a piston slide located upstream of the solid discharge openings.

17. The centrifuge according to claim 1, wherein the deflection of the product occurs into the tubular elements.

18. The centrifuge according to claim 1, wherein the at least two distributor channels each have a tubular shape and the at least two distributor channels are radially in alignment with the tubular elements.

19. The centrifuge according to claim 1, wherein the drum is configured as a nozzle drum.

20. The centrifuge according to claim 1, wherein the tubular elements include a cross-section having a semi-circular or angular shape.

21. The centrifuge according to claim 1, wherein the tubular elements are formed from a multiplicity of parts from ribs arranged at an angle with respect to each other.

22. A centrifuge, such as a continuously working separator, comprising:

a drum having a vertical rotational axis, a single or double conical inner jacket, an inlet pipe, a distributor into which the inlet pipe opens, the distributor having at least two distributor channels distributed about a circumference of the distributor, and a disk package including separator disks, tubular elements distributed on an outside circumference of the disk package, the tubular elements being fastened externally to the separator disk package, a piston slide in the drum, and depressions shaped as a duct and arranged on a surface of the piston slide facing an interior space of the drum beneath an opening area of each distributor channel into the drum, which depressions extend from the opening area in a radial manner up to and over the outside circumference of the disk package and arranged, in an end region of the depressions, such that the depressions deflect a product stream guided through the at least two distributor channels into the drum axially upwardly parallel to the rotational axis and radially outside of the largest circumference of the separator disk package.

23. A centrifuge, such as a continuously working separator, comprising:

a drum having a vertical rotational axis, a single or double conical inner jacket, an inlet pipe, a distributor into which the inlet pipe opens, the distributor having at least two distributor channels distributed about a circumference of the distributor, and a disk package including separator disks;

tubular elements distributed on an outside circumference of the disk package;

the tubular elements being fastened externally to the separator disk package; and wherein the tubular elements are arranged in the rotational direction of the drum behind lugs between the separator disks.

* * * * *